US006164041A

United States Patent [19]

Focke et al.

[11] Patent Number: 6,164,041

[45] Date of Patent: Dec. 26, 2000

[54] METHOD AND APPARATUS FOR PACKAGING

[75] Inventors: Heinz Focke; Johann Köster, both of Verden, Germany

[73] Assignee: Focke & Co., (GmbH & Co.), Verden, Germany

[21] Appl. No.: 09/114,868

[22] Filed: Jul. 14, 1998

[30] Foreign Application Priority Data

Jul. 22, 1997 [DE] Germany ..... 197 31 509

[51] Int. Cl.[7] ..... B65B 35/40

[52] U.S. Cl. ..... 53/448; 53/171; 53/228; 53/234; 53/446; 53/466; 53/544

[58] Field of Search ..... 53/171, 234, 258, 53/446, 448, 544, 228, 229, 230, 232, 247, 252, 466, 543

[56] References Cited

U.S. PATENT DOCUMENTS

| | | | |
|---|---|---|---|
| 2,277,408 | 3/1942 | Molins et al. | 53/537 X |
| 2,796,709 | 6/1957 | Bolding | 53/443 X |
| 3,068,624 | 12/1962 | Linda . | |
| 3,253,385 | 5/1966 | Beermann et al. | 53/234 X |
| 3,507,089 | 4/1970 | Mizelle et al. | 53/230 X |
| 4,161,093 | 7/1979 | Focke | 53/228 |
| 4,711,065 | 12/1987 | Focke et al. | 53/171 X |
| 4,756,139 | 7/1988 | Le Bras | 53/443 X |
| 4,843,800 | 7/1989 | Focke . | |
| 4,932,190 | 6/1990 | Bergher et al. | 53/443 X |
| 4,936,077 | 6/1990 | Langen et al. | 53/543 |
| 5,133,173 | 7/1992 | Draghetti et al. | 53/230 X |
| 5,216,870 | 6/1993 | Boriani et al. | 53/228 X |
| 5,241,806 | 9/1993 | Ziegler et al. | 53/237 X |
| 5,357,734 | 10/1994 | Focke et al. . | |

FOREIGN PATENT DOCUMENTS

| | | |
|---|---|---|
| 3123496A | 1/1983 | Germany . |
| 4226896A1 | 4/1993 | Germany . |
| 4200921A1 | 7/1993 | Germany . |
| 4335666A1 | 4/1995 | Germany . |
| 397519 | 2/1996 | Germany . |
| 19535649A1 | 3/1997 | Germany . |
| 06001312 | 1/1994 | Japan . |
| 08151015 | 6/1996 | Japan . |

*Primary Examiner*—Daniel B. Moon
*Attorney, Agent, or Firm*—Abelman Frayne & Schwab

[57] ABSTRACT

Packaging a plurality of cuboid containers, such as cigarette packs, in a package that is larger than the containers is enabled by arranging the containers in an offset array in which adjacent sides of the containers are offset from each other by a predetermined amount. A blank of relatively stiff material is folded around the array to form the package. The amount the containers are offset in the array is the same amount by which the package sides are longer than the adjacent sides of the containers. This enables the array in effect to fill the package even though the containers themselves are smaller than the package. The invention is particularly useful for cigarette packs since it enables the same package blank to be used for different size cigarette packs.

17 Claims, 5 Drawing Sheets

METHOD AND APPARATUS FOR PACKAGING

BACKGROUND OF THE INVENTION

1. Field of the Invention

The invention relates to a method and device for manufacturing packaging (containers) by wrapping a group of objects, specially comprising individual packs—packaging group.

2. Description of Related Art

By priority, the invention relates to packaging containers for a group of cigarette packs, also called 'cigarette carton'. Packaging containers of this kind generally consist of ten cuboid cigarette packs which are surrounded by a blank of foldable material. The cigarette packs are generally formed into two rows, each two cigarette packs lying against one another with their front and rear sides (formation of a double row).

The practice of packaging technology frequently has to address the problem that the dimensions of the prefabricated blanks for the wrapping of the packaging container frequently do not correspond exactly to the dimensions of the container's contents, i.e. especially those of the packaging group. This problem occurs above all with packaging containers for cigarettes on which the outer wrapping consists of (thin) cardboard or some other comparatively stiff packaging material.

SUMMARY OF THE INVENTION

The object underlying the invention is accordingly to propose measures which ensure, where the dimensions of the packaging contents are different from those of the blank of the wrapping, that the packaging (container) nevertheless has an attractive, faultless outer appearance.

In fulfillment of this object, the method according to the invention for manufacturing packaging (containers) is characterized in that, with a (slightly) larger wrapping than the group to be wrapped, the individual objects or individual packs within the packaging (container) are offset in relation to one another at least during the packaging process, in such a way that a (largish) inner space of the packaging (container) is filled by the group.

In the manufacture of cigarette containers or cigarette cartons with a wrapping made of thin cardboard, the height of the pack, i.e. the measurement between a base wall and a closing side, as a result of corresponding dimensions of the blank, is greater than the upright dimension of the cigarette pack (measurement in a longitudinal direction of same). These differences of dimension occur above all due to the fact that a uniform type of blank is held in readiness for the wrapping and used for cigarette packs of different dimensions.

In order, nevertheless, to bring it about that, at least during the process of packaging, i.e. during the wrapping process for the packaging group, the dimensions of the packaging contents and of the blank are matched to one another, the (cigarette) packs of the packaging group are grouped offset to one another, such that, as a result of the displacement, the outer contour of the group of packs is adapted to the inner space of the packaging container. Where five pairs of (cigarette) packs are disposed in a row beside one another, in each case three pairs of individual packs are offset in relation to two pairs of individual packs. This altered relative position of the packs inside the packaging group is preferably brought about as said group is pushed into a pocket of a rotary folding unit. A further special characteristic of the invention consists in the fact that, as the folded packaging container is pushed out of the rotary folding unit or during subsequent transverse pushing into an onward conveying path, the closing side of the packaging container is grasped by a corresponding slide. For this purpose, the slide protrudes over the contour of the packaging container.

Further details of the invention relate to method steps and device members to protect the packaging container where there are oversized blanks for the wrapping of the packaging group.

BRIEF DESCRIPTION OF THE DRAWINGS

Details of the packaging (container) and of the device for producing same are explained more fully below with the aid of the drawings. These show.

DETAILED DESCRIPTION OF PREFERRED EMBODIMENTS

Figure 1:
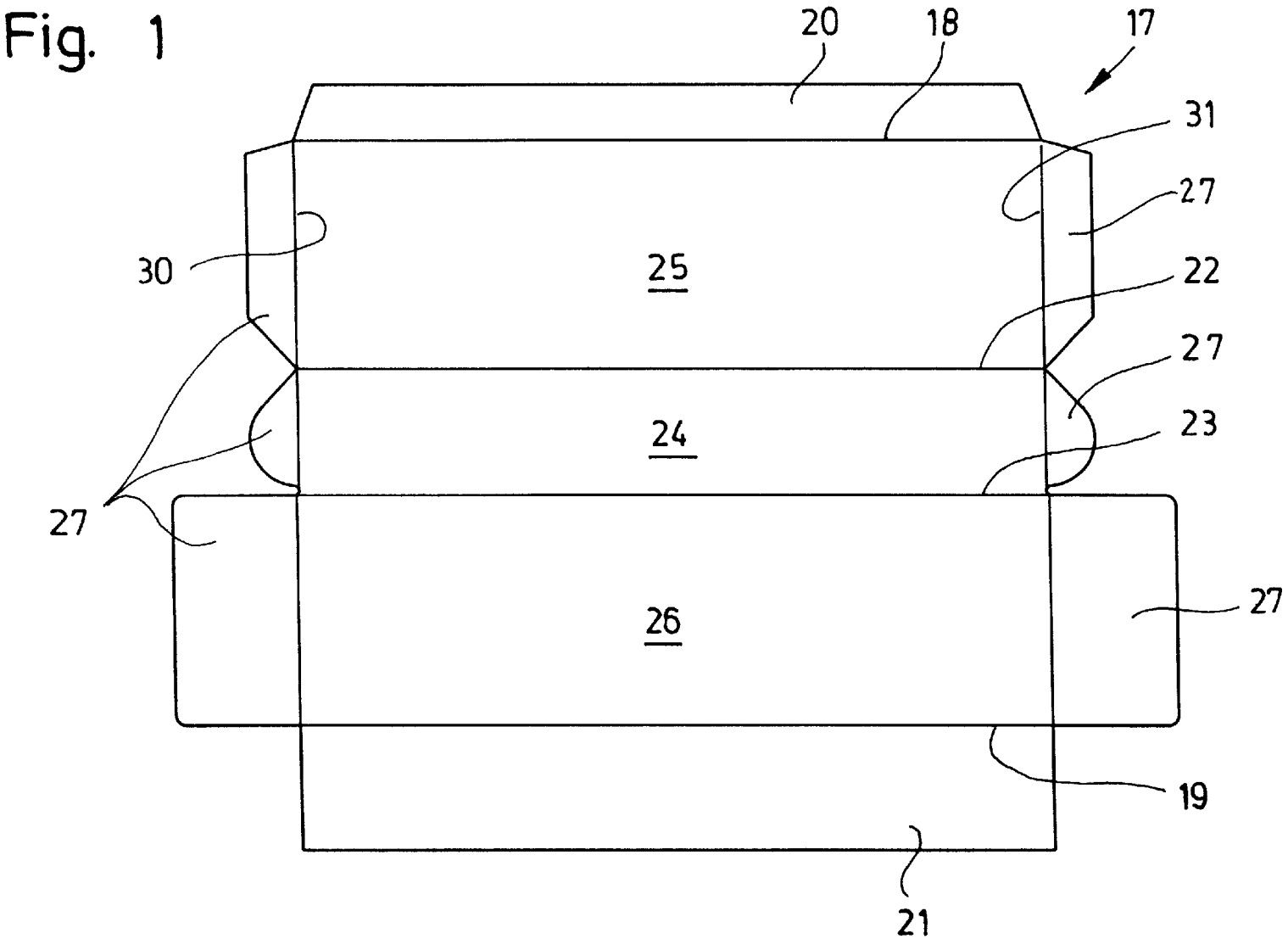
FIG. 1 a blank made of (thin) cardboard or similar for a packaging container for cigarettes, in spread-out state, FIG. 2 details of a device for manufacturing a packaging container, in side view, FIG. 3 a detail of the device according to FIG. 2, on a greatly enlarged scale, FIG. 4 a further detail of the device according to FIG. 2, likewise on a greatly enlarged scale, FIG. 5 a region in which the packaging container is pushed away after exiting from a rotary folding unit, FIG. 6 a view, displaced by 90°, of the detail as per FIG. 5.

The patent drawings are concerned with the preferred area of application, namely with the design and manufacture of packaging containers 10 for cigarettes. A packaging container 10 of this type—cigarette carton—generally consists of a packaging group 11 with ten individual packs or cigarette packs 12. These are positioned in two rows 13, 14 and aligned in relation to one another in such a way that the front side 15 and rear side 16 of adjacent cigarette packs 12 lie against one another. Five such pairs of cigarette packs 12 lie beside one another to form the packaging group.

The packaging group 11 is surrounded by a wrapping 17 which generally consists of thin cardboard but can also be manufactured from other packaging material. The wrapping 17 is made available as a finished blank produced by stamping. FIG. 1 shows a possible, advantageous form of design of a blank for the wrapping 17.

By embossing the blank of the wrapping 17, prepared folding lines are produced on it, namely longitudinal folding lines 18 and 19 to delimit closing flaps 20 and 21. Parallel to these lines run base folding lines 22, 23 to delimit a base wall 24. Folding lines 18 and 22 on the one hand, as well as 19 and 23 on the other hand, delimit long stretched-out side walls 25, 26 of the packaging container 10. Adjoining the base wall 24 and the side walls 25 and 26 there are respectively folding flaps 27, 28 which form end walls 29 of the packaging container 10 as a result of corresponding folding and overlapping. Folding flaps 27, 28 are separated by transverse folding lines 30, 31 from the adjacent walls of the packaging container 10.

The cigarette packs 12 are positioned inside the packaging container 10 in such a way that small surfaces of the cigarette packs 12, especially an (upper) front side 32, face the base wall 24 of the wrapping 17. Base sides 33 of the cigarette packs 12 face a closing side of the packaging container 10,. namely the closing flaps 20, 21 which partially cover one another in the closed position.

Figure 2:
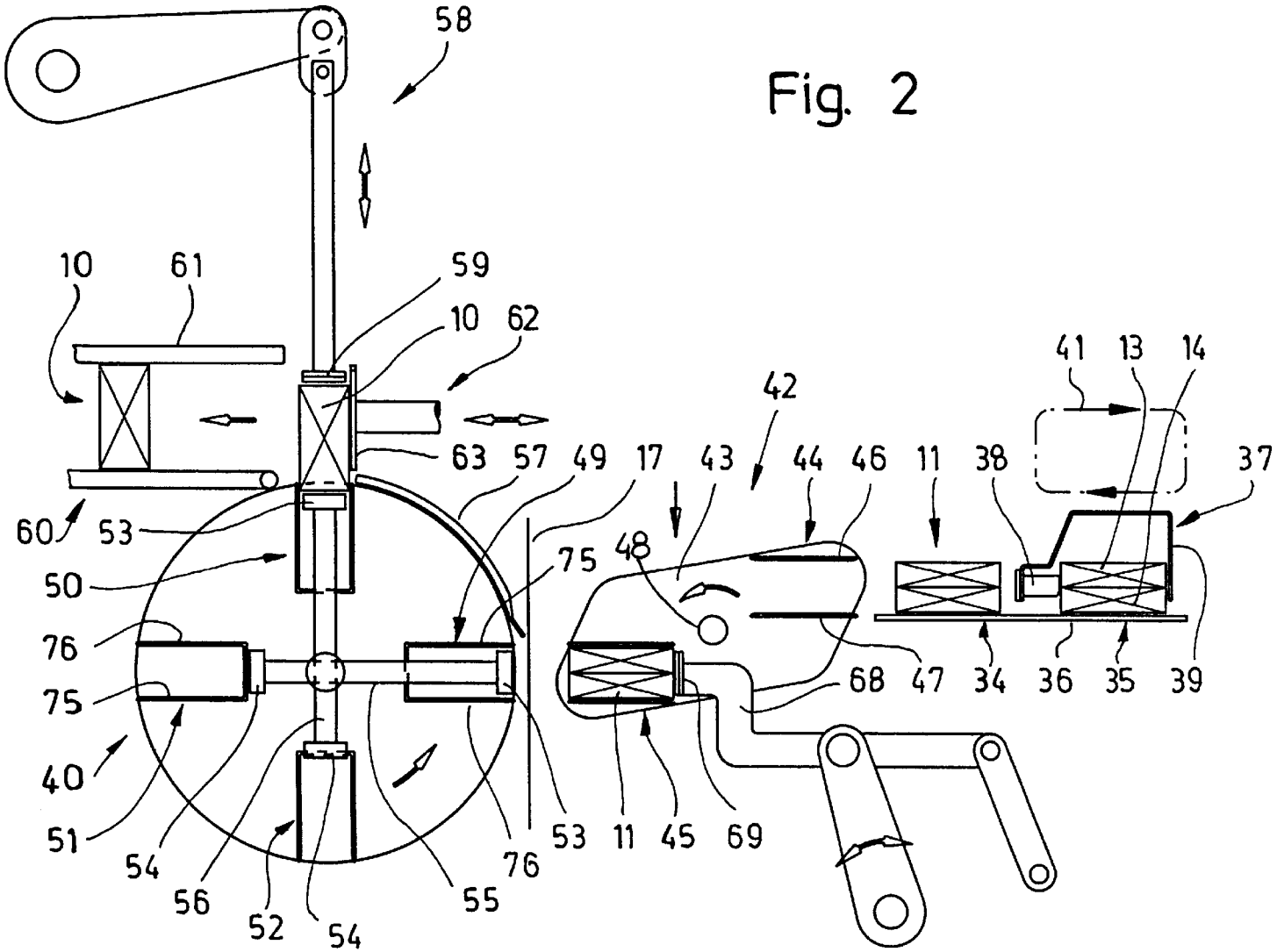

To produce the packaging container 10, the packs, namely cigarette packs 12, are led in two lines of packs 34, 35 on a plate-shaped track 36. From the two lines of packs 34, 35, packaging group 11, corresponding to the contents of the packaging container 10, is separated in one working cycle by a transverse pushing movement. To this end, a double slide 37 is moved transversely to the lines of packs 34, 35. The double slide 37 is equipped with one catch 38 for the one line of packs 34 and with a second catch 39 for the other line of packs 35. With one sweep of the double slide 37 (in FIG. 2 from right to left), a complete packaging group 11 is separated from the line of packs 34 and led to a rotary folding unit 40 or to an intermediate conveyor placed in front of same. A second packaging group 11 is separated from the line of packs 35 by catch 39 and positioned in the end position of the double slide 37 as a continuation of the line of packs 34, i.e. in an intermediate position on the track 36. The double slide is then moved upwards and returns to its initial position in a plane above the lines of packs 34, 35. A movement path 41 of the double slide 37 is shown in a dot-dash line in FIG. 2. In the next working cycle of the double slide 37, the (second) packaging group 11 positioned in the region of the line of packs 34 is led by catch 38 to the intermediate conveyor.

The intermediate conveyor or conveyor for transferring the packaging groups 11 to the rotary folding unit 40 is configured as a reverse rotary unit. On a rotatable carrier 43 of same are disposed two receiving means 44 and 45, lying diametrically opposite one another, each for one packaging group 11. The receiving means 44, 45 consist in each case of an upper and a lower holding device, namely an upper wall 46 and a lower wall 47. The packaging group 11 is received between these walls. Upper wall 46 and lower wall 47 are so positioned that the packaging group 11 is held with a certain tension or clamping effect in the respective receiving means 44, 45.

The disc-shaped carrier 43 may be rotated by a horizontal shaft 48, anti-clockwise in the present case. The carrier 43 is in each case rotated by 180°. By this means, one receiving means 44 reaches a charging station adjacent to the track 36 to push in one packaging group 11 via an open side. The other receiving means 45 is simultaneously located in a discharge station. Here one packaging group 11 is conveyed out of the receiving means 45 facing the rotary folding unit 40 and pushed into a pocket 49 of the rotary folding unit 40. The receiving means 44, 45 are disposed on the carrier 43 offset in height. Pushing the packaging group 11 into a receiving means takes place in a higher plane than pushing out of the respective other receiving means.

The packaging groups 11 are pushed by a slide 68 out of the respective receiving means 44, 45 and into the pocket 49 of the rotary folding unit 40 positioned adjacent to receiving means 45. During this insertion movement, a blank of the wrapping 17 is also taken by the packaging group 11. The wrapping 17 enters with the packaging group 11 the pocket 49 and places itself on or around the packaging group 11. The blank of the wrapping 17 is here so positioned that the front sides 32, lying at the front during the insertion movement, of the cigarette packs 12 come into exact contact with the base 24 of the (unfolded) wrapping 17.

The rotary folding unit 40 is provided with four pockets 49, 50, 51, 52, arranged at equal peripheral distances from one another. As a packaging group 11 is inserted, the respective pocket 49 is situated in a horizontal plane.

Inside the pockets 49 . . . 52 are arranged counter pressure members whose task, as a packaging group 11 is inserted into a pocket 49 . . . 52, consists in fixing the blank of the wrapping 17 correctly on the facing surfaces f the packaging group 11. What is used here is a tappet 53 which may be moved in a radial direction and is drawn back, corresponding to the insertion of the packaging group 11 into the pocket 49, as far as a base of the pocket 49 . . . 52 lying radially on the inside. The tappets 53, 54 of pockets lying opposite one another 49, 51 or 50, 52 are connected to one another via a common push rod 55, 56.

After a packaging group 11 has been inserted with wrapping 17 into the pocket 49, first of all the folding flap protruding from the pocket 49, namely the (inside) closing flap 20 is folded, against the free base side 33 of the cigarette packs 12. For this purpose, a folding device 81 may be moved in the peripheral direction of the rotary folding unit 40, taking the closing flap 20 with it.

Thereafter, the rotary folding unit 40 is moved on by one cycle, namely by a quarter-circle. During this movement, the second, outer, closing flap 21 is folded into the closed position, by a fixed external guide 57 of the rotary folding unit 40.

Closing flap 20 and/or closing flap 21 are provided with glue or are glued on the sides facing one another, such that closing flaps 20, 21 are glued to one another where they overlap.

In the region of the pocket 50 facing upwards or open upwards, the finished packaging container 10 is pushed upwards out of the pocket 50, by the tappet 53 which is moved correspondingly upwards. In order to ensure that there is a correct sequence of movement as the packaging container 10 is pushed out, and to fix the closing flaps 20, 21 in the closed position, a counter holding device 58 is moved synchronously upwards with a retaining head 59, adjacent to the outer closing flap 21, as a counter member to the tappet 53.

When the packaging container 10 has been completely pushed out of pocket 50, it is pushed away in a transverse or tangential direction from the tappet 53 on to a forward conveyor 60. This conveyor is provided with a fixed upper guide 61, beside which the upper, outer, closing flap 21 lies. The packaging containers 10 are accordingly transported between the onward conveyor 60, configured as a belt conveyor, and the upper guide 61. A transverse slide 62 with slide plate 63 pushes the packaging container 10 from the tappet 53 on to the onward conveyor 60. The counter holding device 58, or its retaining head 59, is located in its upper end position at a small distance above the closing flap 21.

A frequently occurring problem consists in the fact that the dimensions of the individual packs, namely cigarette packs 12 and thus the dimensions of the packaging group 11, are smaller than the predetermined dimensions of the wrapping 17, namely of the walls indicated by folding lines. In particular, the cigarette packs 12 can be of shorter height, i.e. have a shorter measurement in a longitudinal direction along upright pack edges 64 than the width or height of the corresponding side wall 25, 26 of the wrapping 17. Since the packaging group 11, configured with a shorter height, is driven against the base wall 24, in the region of the closing side of the packaging container 10, i.e. of the closing flaps 20, 21, a cavity is produced which is the reason for an unsatisfactory external appearance of the packaging container 10.

In the present case, the (cigarette) packs 12 of a packaging group 11 are so positioned relative to one another that the overall contour of the packaging group 11 substantially fills the inner space of the folded wrapping 17.

Figure 3:
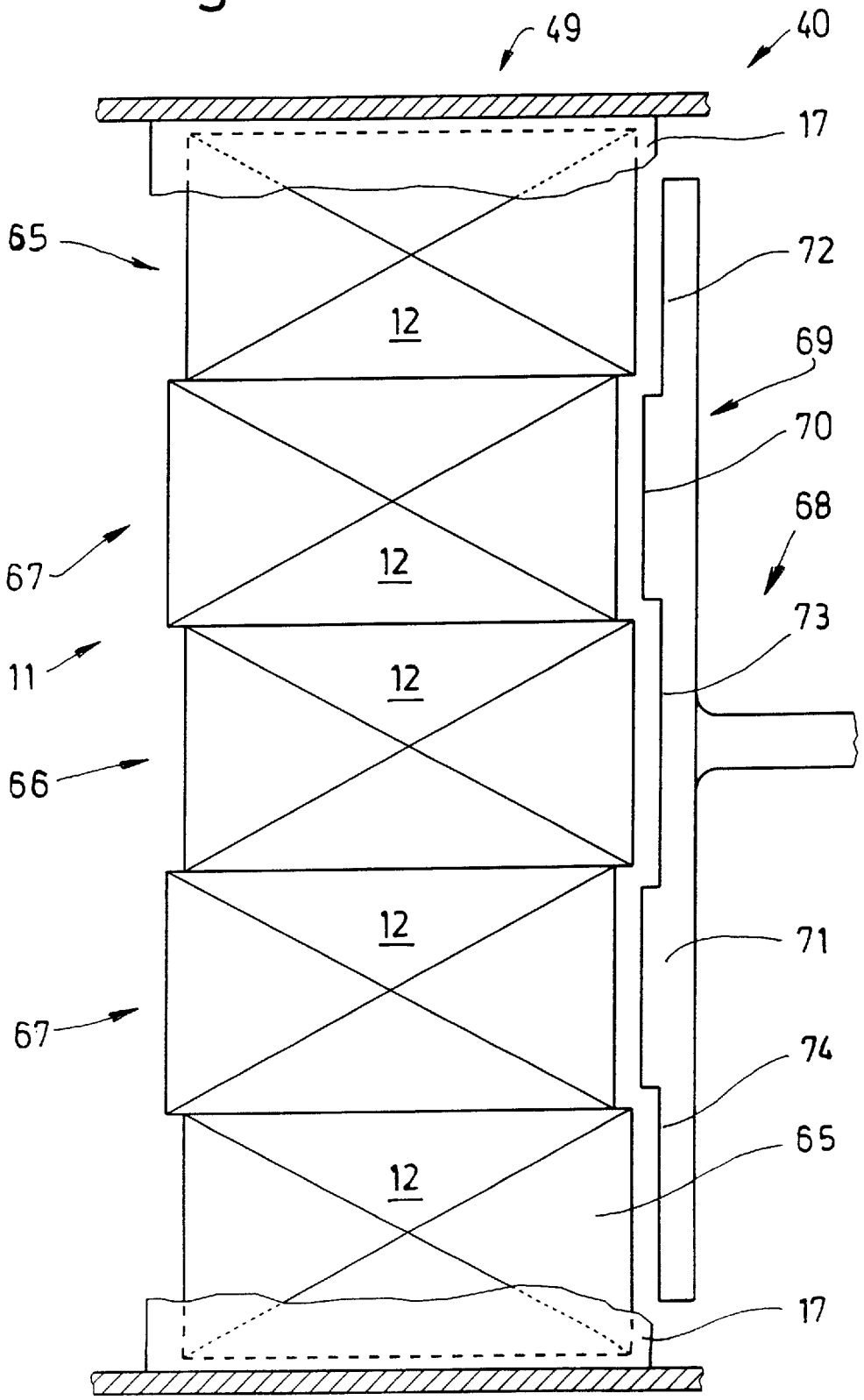
Figure 4:
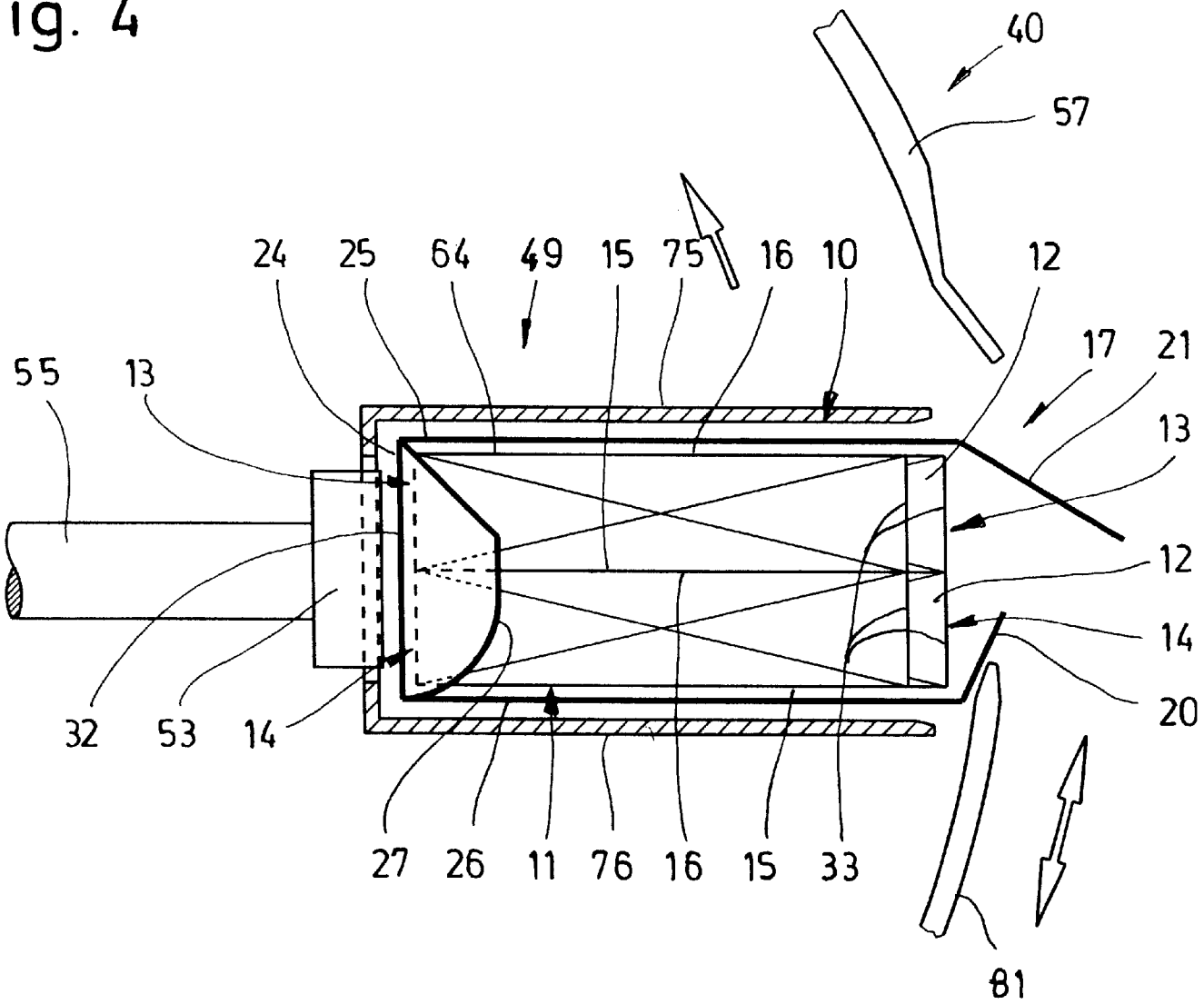
Figure 6:
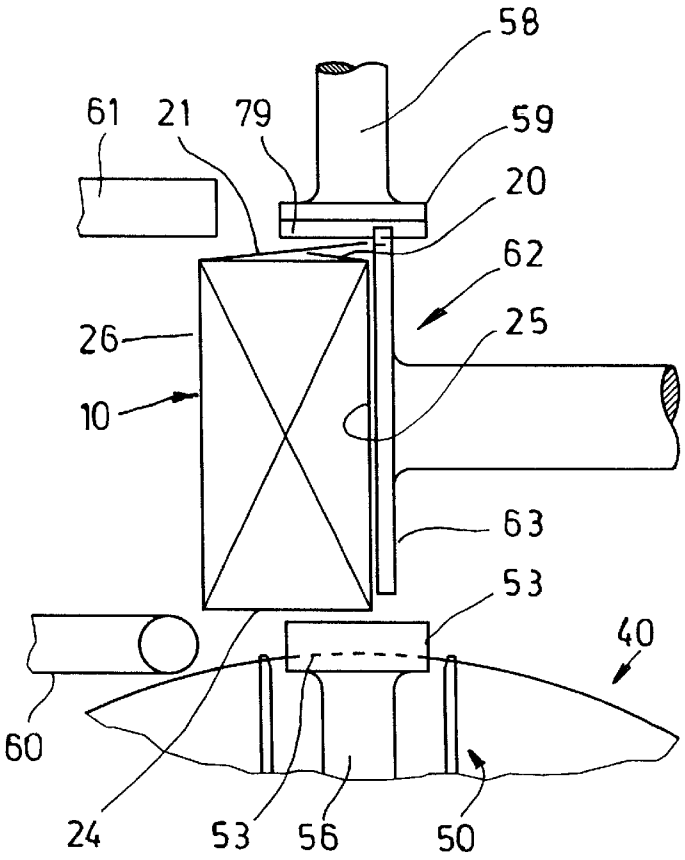
Figure 5:
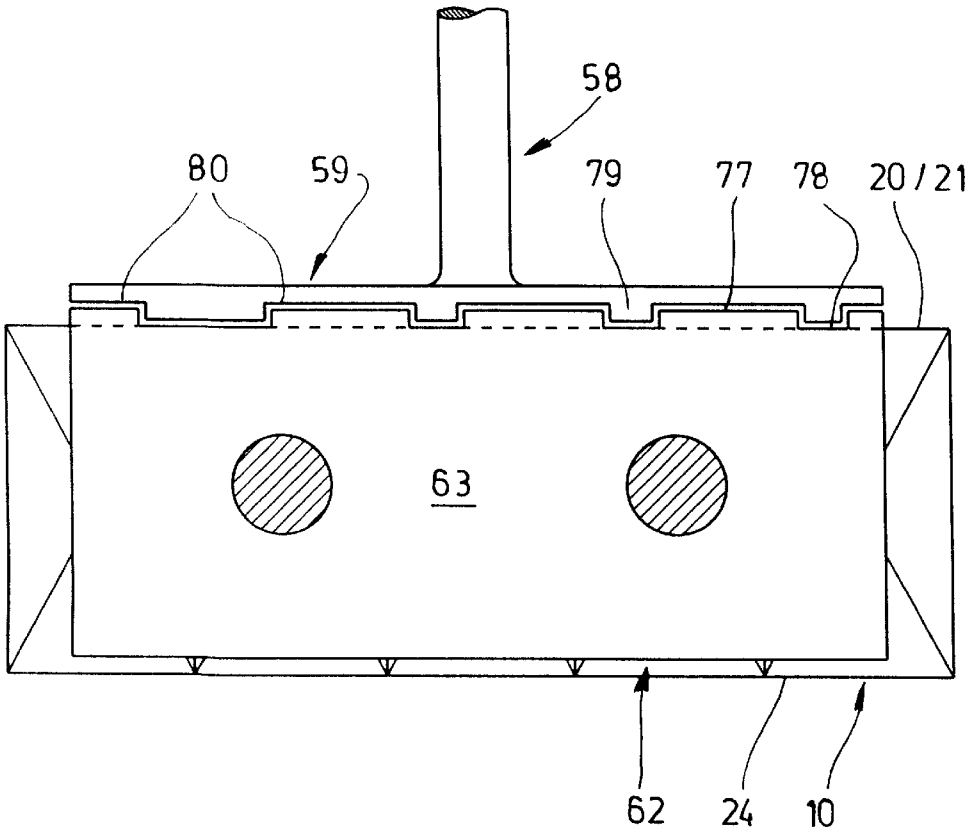

In the present embodiment, the cigarette packs 12 are arranged offset in height to one another. FIG. 3 shows a packaging group 11 in plan view. The cigarette packs 12 or each two adjacent cigarette packs 12 are disposed offset to neighboring cigarette packs 12. According to FIG. 3, the arrangement is such that within the formation of the packaging group 11, cigarette packs lying on the outside, namely outer pairs of packs 65 and one central pair of packs 66 are arranged displaced in one direction and the pairs of packs 67 arranged between them are displaced in the other direction. Within the packaging container 10 the inner pairs of packs 67 lie beside the base wall 24, and thus support the whole packaging group 11 in this region on the wrapping 17, The other pairs of packs 6S, 66 are turned toward the closing side, i.e. the closing flaps 20, 21 and are adjacent to same. It is of importance here that the outer pairs of packs 65 face the closing side, i.e. the closing flaps 20, 21 and support the sensitive end region of this side of the packaging container.

The formation of the packaging group 11 filling the packaging container 10 is created before the union of same with the blank of the wrapping 17, i.e. at least as the packaging group 11 is inserted into the pocket 49 of the rotary folding unit 40. To this end, the slide 68 is provided with a plate-shaped slide head 69 which, because of a contoured surface, causes the displacement of the packs or pairs of packs 65, 66, 67 of the packaging group during the insertion movement. The slide head 69 is to this end provided with projections 70, 71 which, in the region of the pairs of packs 67, lie next to the facing surfaces, namely to the base sides 33, of the cigarette packs 12. The projections 70, 71 are slightly smaller in width than the cigarette packs 12. The projections 70, 71 form a misalignment in relation to the other surface regions of the slide head 69. The pairs of packs 65 and 66 are adjacent to set-back surfaces 72, 73, 74 of the slide head 69.

The pockets 49 . . . 52, are of such dimensions, namely on the basis of the spacing of pocket walls 75, 76, that the formation of the packaging group 11 caused by the slide 68 is stabilized in the pocket 49, 50. The packaging group 11 with wrapping 17 is held under tension in the pocket 49 . . . .

In the present embodiment, a preforming of the offset relative position of the packs or pairs of packs 65, 66, 67 of the packaging group 11 is expediently effected, by the catch 38 of the double slide 37. This is configured analogously to slide 68 or slide head 69, namely with projections and recesses which cause the offset of the neighboring pairs of packs 65, 66, 67 which can be recognized in FIG. 3.

A further special characteristic is provided in the region where the packaging containers 10 are pushed out of the rotary folding unit 40, or in the region in which they are pushed out transversely by the transverse slide 62. In order to support the sensitive region of the closing side of the packaging container 10, namely the region of the closing flaps 20, 21, the slide plate 63 extends beyond the contours of the packaging container 10. In this way it is ensured that, when the packaging container 10 is pushed transversely it is grasped along its full height, especially in the region of the closing flaps 20, 21 as well.

In this region, however, the counter holding device 58 is also effective, the retaining head 59 of which is intended to secure the closing flaps 20, 21 in the closed position. The retaining head 59 lies beside the closing flaps 20, 21 or is positioned at a slight distance from same, In order, nevertheless, to guarantee that the packaging group 10 is pushed out without any problem, the underside or the side of the retaining head 59 facing the packaging container 10 on the one hand, and an upper edge region of the slide plate 63 on the other hand, are so designed that the latter can be moved past the retaining head 59 during the pushing out movement.

In the present embodiment, an upper edge of the slide plate 63 consists of projections 77 and depressions 78. Suitably configured projections 79 of the retaining head 59 go into the depressions 78. The projections 77 of the slide plate 63 protrude into depressions 80 of the retaining head 59. In this way, the two holding and supporting members, namely retaining head 59 on the one hand and slide plate 63 on the other hand, can be effective with an overlap.

LIST OF REFERENCE NUMBERS

10 packaging container
11 packaging group
12 cigarette pack
13 row
14 row
15 front side
16 rear side
17 wrapping
18 longitudinal folding line
19 longitudinal folding line
20 closing flap
21 closing flap
22 base folding line
23 base folding line
24 base wall
25 side wall
26 side wall
27 folding flap
28 folding flap
29 end wall
30 transverse folding line
31 transverse folding line
32 front side
33 base side
34 line of packs
35 line of packs
36 track
37 double slide
38 catch
39 catch
40 rotary folding unit
41 movement path
42 reverse rotary unit
43 carrier
44 receiving means
45 receiving means
46 upper wall
47 lower wall
48 shaft
49 pocket
50 pocket
51 pocket

52 pocket
53 tappet
54 tappet
55 push rod
56 push rod
57 external guide
58 counter holding device
59 retaining head
60 onward conveyor
61 upper guide
62 transverse slide
63 slide plate
64 pack edge
65 pair of packs
66 pair of packs
67 pair of packs
68 slide
69 slide head
70 projection
71 projection
72 surface
73 surface
74 surface
75 pocket wall
76 pocket wall
77 projection
78 depression
79 projection
80 depression
81 folding device

What is claimed is:

1. A method of packaging a plurality of cuboid containers, said method comprising the steps of:

arranging said containers in an offset array, wherein sides of said containers are disposed adjacent to each other to provide said array with substantially planar opposite faces and said adjacent containers are offset from each other by a predetermined amount along said adjacent sides to offset the ends of said containers;

providing a blank of relatively stiff material that is foldable into a receptacle having a base wall connecting opposite faces with sides longer than said adjacent sides of said containers by an amount substantially equal to said amount by which said adjacent sides of said containers are offset from each other; and folding said blank around at least three sides of said array to form a receptacle with said base wall facing offset ends of said containers and said opposite faces of said receptacle facing said opposite faces of said array.

2. A method according to claim 1, further comprising the step of folding and securing flaps on said blank to form a completed package enclosing said array.

3. A method according to claim 1, wherein said array includes a plurality of rows of adjacent containers in face to face relation, said adjacent containers in each said row being offset substantially the same amount.

4. A method according to claim 3, wherein said array includes two rows of five containers each, the end and center containers in each said row being offset from the other two containers in said rows.

5. A method according to claim 4, wherein said receptacle includes an open side opposite said base wall and in contact with said end and said center containers in said array.

6. A method according to claim 1, wherein said folding step comprises pushing said blank into a pocket with said array using a slide having a head configured to offset said ends of said adjacent containers.

7. A method according to claim 6, wherein said head has raised portions for offsetting said ends of said adjacent containers as said slide pushes said array into said pocket, said method further comprising the step of withdrawing said slide from said pocket.

8. A method according to claim 1, wherein said containers are cigarette packs.

9. A method according to claim 1, wherein said containers are substantially identical with opposite major faces, two side faces, a top end and a bottom end, with said containers being disposed in said array with said side faces of adjacent said containers in contact and said major faces of adjacent said containers lying in a plane forming said faces, said top ends and said bottom ends of said adjacent containers being offset.

10. An apparatus for packaging a plurality of cuboid containers, said apparatus comprising:

an assembler for arranging said containers in an array, wherein sides of said containers are disposed adjacent to each other to provide said array with substantially planer opposite faces;

a rotary folding unit with at least one pocket for folding a blank of relatively stiff material into a receptacle with opposite faces having sides longer than said adjacent sides of said containers; and a slide for pushing said blank into said pocket using said array to fold said blank around at least three sides of said array with said opposite faces of said receptacle connected by a base wall and facing said opposite faces of said array, wherein said slide includes a head configured to offset adjacent said containers along said adjacent sides by an amount substantially equal to the amount by which said sides of said receptacle are longer than said adjacent sides of said containers.

11. An apparatus according to claim 10, wherein said head has raised portions for offsetting said containers as said slide pushes said array into said pocket.

12. An apparatus according to claim 10, wherein said pocket frictionally holds said containers in said array with said adjacent containers offset by an amount substantially equal to the amount by which said sides of said receptacle are longer than said corresponding sides of said containers.

13. An apparatus according to claim 10, wherein said rotary folding unit includes a plurality of said pockets, said apparatus further comprising:

an intermediate conveyor having plural holding devices for receiving said arrays, said holding devices being mounted for movement to accept individual said arrays in turn and align them with one of said pockets; and a separating mechanism for separating a column of said containers on said intermediate conveyor into a single row for insertion into one of said holding device; said separating mechanism including a catch for offsetting adjacent said containers in said row.

14. An apparatus according to claim 13, wherein said containers are cigarette packs and said array includes two said rows of five said packs each, the end and center said packs in each said row being offset an equal amount from the other two said packs in each said row.

15. An apparatus according to claim 10, wherein said rotary folding unit includes a plurality of said pockets, each arranged to accept one of said arrays when said pocket is in a horizontal orientation, said rotating unit thereafter rotating said pocket 90° into a vertical orientation, said apparatus further comprising:

a tappet member for pushing said array and said receptacle upward out of said vertically oriented pocket; and a transverse slide for moving said receptacle containing said array in a horizontal direction after it is pushed out of said pocket by said tappet.

16. An apparatus according to claim 15, further comprising a folding device for folding open flaps of said blank around said open end of said receptacle as said rotary folding unit rotates said pocket from said horizontal to said vertical orientation; and a counter holding device for holding said folded flaps in position as said tappet pushes said receptacle out of said pocket and as said transverse slide moves said receptacle containing said array in a horizontal direction after it is pushed out of said pocket.

17. An apparatus according to claim 16, wherein said transverse slide includes an upper side with protrusions extending beyond an upper end of said folded flaps and said counter holding device includes depressions entered by said protrusions as said transverse slide moves said receptacle containing said array in a horizontal direction.

* * * * *